United States Patent [19]

Poutiainen et al.

[11] Patent Number: 4,585,137

[45] Date of Patent: Apr. 29, 1986

[54] BOTTLE HAMPER

[75] Inventors: Kari Poutiainen, Nastola; Timo Taina, Kausala, both of Finland

[73] Assignee: Asko Oy, Nastola, Finland

[21] Appl. No.: 593,925

[22] Filed: Mar. 27, 1984

[30] Foreign Application Priority Data

Mar. 31, 1983 [FI] Finland ..... 831114

[51] Int. Cl.[4] ..... B65D 25/04; B65D 1/24

[52] U.S. Cl. ..... 220/21; 206/427; 211/126; 220/22

[58] Field of Search ..... 220/21, 22; 206/427; 211/126

[56] References Cited

U.S. PATENT DOCUMENTS

| | | | |
|---|---|---|---|
| 3,151,761 | 10/1964 | Cloyd | 220/21 |
| 3,416,694 | 12/1968 | Bebb | 220/21 |
| 3,841,519 | 10/1974 | Stromberg | 220/21 |
| 4,067,474 | 1/1978 | Prodel | 220/21 |

FOREIGN PATENT DOCUMENTS

| | | | |
|---|---|---|---|
| 1883773 | 11/1963 | Fed. Rep. of Germany . | |
| 2556449 | 6/1977 | Fed. Rep. of Germany . | |
| 1315550 | 12/1962 | France . | |
| 6505562 | 10/1966 | Netherlands | 220/21 |

*Primary Examiner*—George E. Lowrance

*Attorney, Agent, or Firm*—Kenyon & Kenyon

[57] ABSTRACT

This invention relates to a bottle hamper the sidewall of which has a removal opening for bottles and on the bottom of which there is a framework of vertical partitions to support the lower parts of the bottles sidewise. One problem with such hampers has been the locking of bottles in the hamper during transport and different movable bars have therefore been mounted in the removal opening. A bottle hamper can be manufactured without these separate movable parts if the partitions perpendicular to the plane of the removal opening have supporting devices projecting on both sides, which devices support the bottles in the direction of the partitions and are secured to the partitions so that they can be displaced in a transversal direction as regards the partitions into the adjacent compartments when bottles are removed from the bottle hamper.

3 Claims, 4 Drawing Figures

BOTTLE HAMPER

Figure 1:
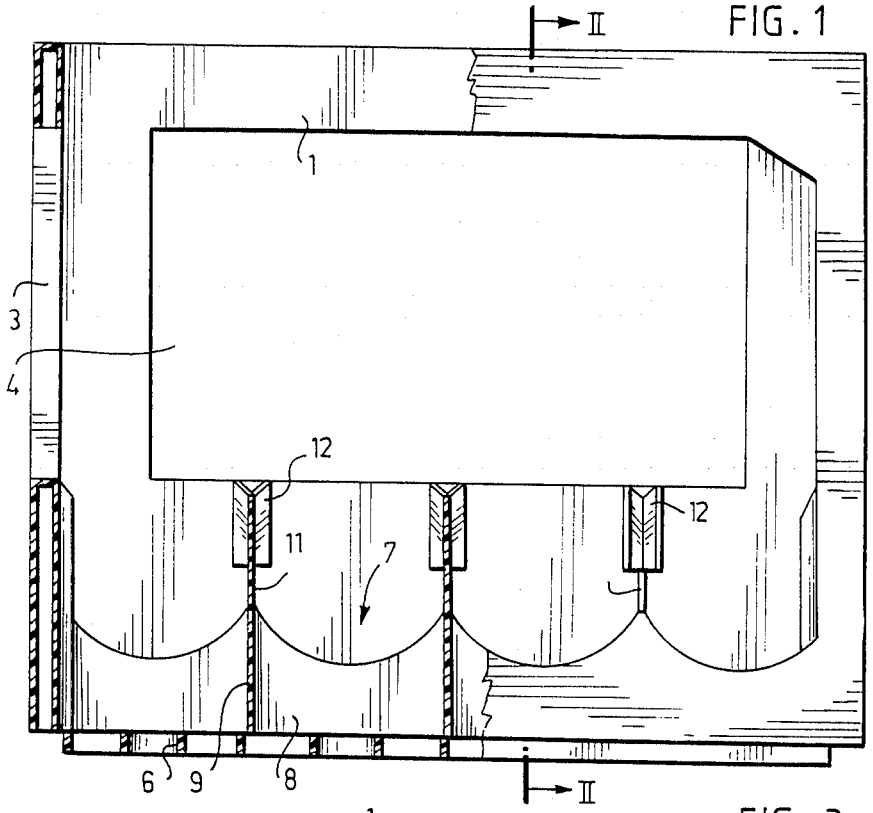

The object of this invention is a bottle hamper in the sidewall of which there is an opening through which the bottles can be removed from the hamper and on the bottom of which there is a framework of vertical partitions to support the lower parts of the bottles sidewise.

Nowadays most bottle hampers are made such that the bottles can be removed through the side opening, because then the hampers can be placed upon each other in the shops. At the same time, it has to be seen to that the bottles stay in their places in the hampers during transport from the brewery to the shops.

In one known solution these two objects have been achieved by providing the removal opening of the bottle hamper with a horizontal batten movable vertically. In its lower position the batten is located half-way up the removal opening thus preventing the bottles from getting out through the opening during transport. When the bottle hamper is in a shop, the batten is lifted to its upper position along the upper border of the removal opening, whereby the bottles can be removed from the hamper. In another similar solution a screen-work placed between the bottles is secured to the batten.

Both the above solutions have the disadvantage that a separately manufactured element is to be mounted into the hamper, which increases the production costs. Moving the batten from one position to another produces also often problems, because the batten often takes up a slanting position, whereat it gets stuck. To lock the batten in its upper position the bottle hamper is furthermore to be provided with locking devices which, as time goes by, may wear so that they are unable to keep the batten in the upper position.

The purpose of this invention is to provide a bottle hamper from which the bottles can be removed through a side opening, but which despite this does not need a separate means to keep the bottles in the hamper during transport. The bottle hamper according to the invention is characterized in that the partitions which are perpendicular to the plane of said removal opening are provided with supporting devices supporting said bottles in the direction of said partitions, which devices project to both sides of the partitions and are secured to the partitions so that they can be displaced elastically in a transversal direction as regards said partitions when bottles are removed from the bottle hamper.

By providing the partitions in the direction of the bottle removal motion with bottle supporting devices movable in the cross direction as regards this removal motion, a bottle hamper is provided from which one bottle at a time can be removed, but from which a whole row of bottles cannot get out at the same time. This results from the fact that, when one bottle is taken from its compartment, the supporting devices on the path of the bottle move in the direction of the adjacent compartments extending into them more than normally. If, on the contrary, all the bottles in a row parallel with the plane of the removal opening try to get out through the opening at the same time, the supporting devices cannot move away from the path of the bottles, because the displacement forces caused to the supporting devices of adjacent bottles nullify each other. In consequence, bottles can be removed without trouble one by one from the bottle hamper as happens when a customer buys beverages in a shop. During transport the bottle hamper is full and when the hamper is inclined all the bottles try to get out of the hamper simultaneuosly, whereat the supporting devices, as mentioned above, prevent the bottles from getting out of the hamper.

The elastic securing of the supporting devices to the partitions can be provided according to one preferred embodiment so that the supporting devices are secured to the partitions with the means of vertical tongues located midway on each compartment side and attached at their lower end to the partition the supporting devices being secured to their upper end. When removing a bottle from a compartment the tongue turns around its vertical axis thus permitting the supporting devices located before the bottle to move to the side.

So that the successive supporting devices in the same compartment should be located suitably spaced from each other, the supporting devices can preferably be secured to the vertical edges of the tongues.

According to one preferred embodiment the supporting devices are, seen from above, substantially V-shaped the junction of the arms being secured to the vertical edge of the tongue. Such a supporting device is itself flexible making the removal of the bottles easier. This circumstance makes the locking of the bottles in the hamper more secure than before, because to remove bottles from the hamper the elastic force of both the supporting devices and the tongues has to be won.

The supporting devices can also be inflexible, e.g. have the shape of an equal-sided triangle, the point being secured to the vertical edge of the tongue.

Instead of the supporting devices being secured to the tongues extending upwards from the partitions, the partition can be made, along its whole length, as high as the tongue, whereat its upper edge is located about halfway up the bottles. The supporting devices can in this case be formed by protrusions secured face to face to the side surfaces of the partitions, which protrusions can be displaced in the cross direction of the partitions because of the elasticity of the partitions.

Figure 3:
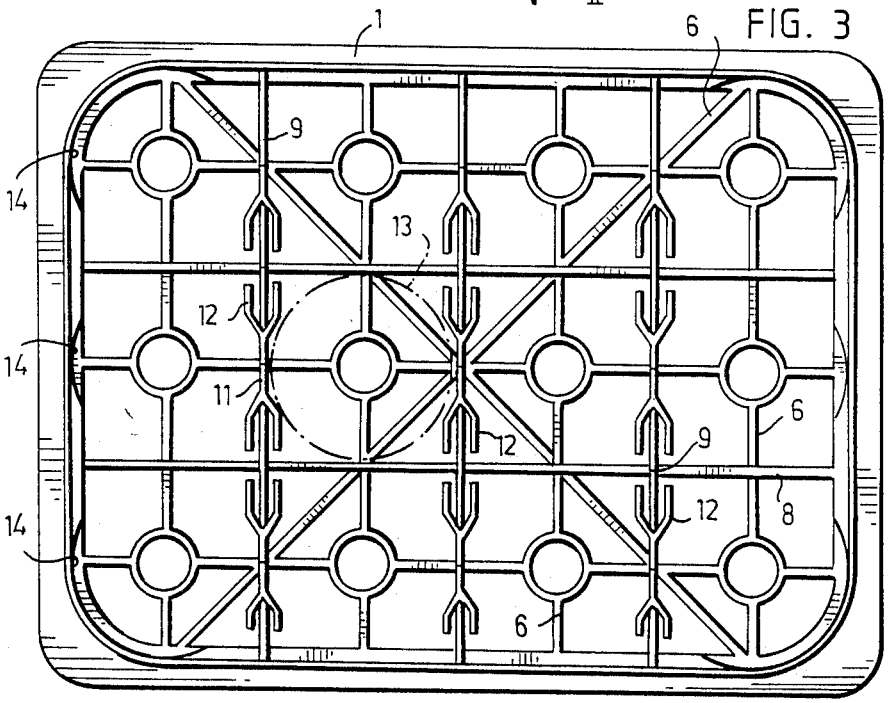
Figure 2:
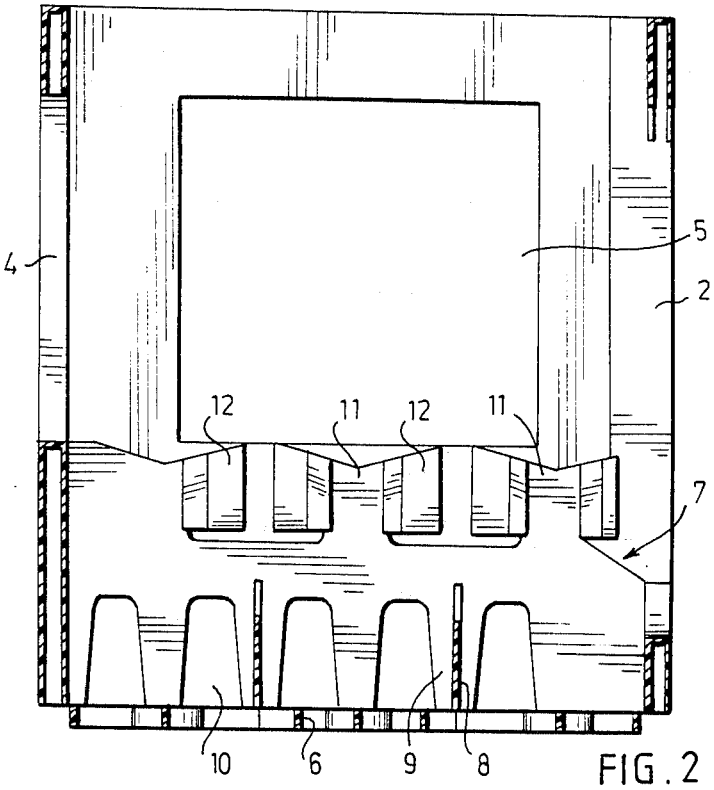
Figure 4:
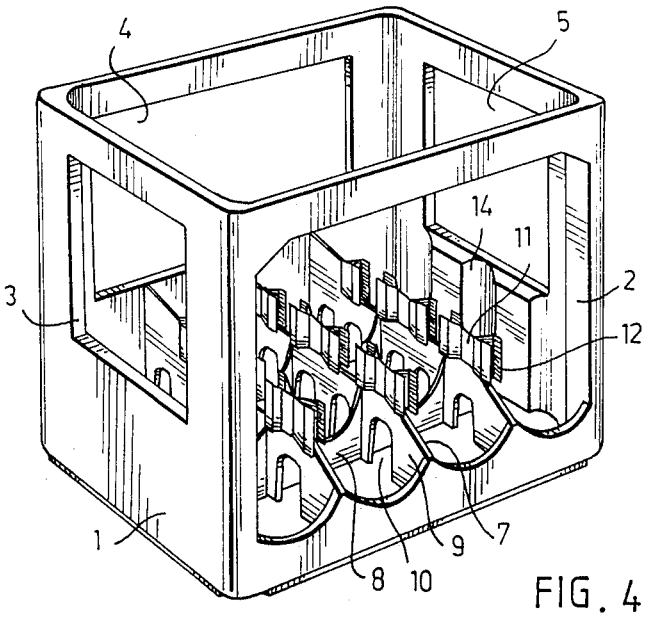

One preferred embodiment of the bottle hamper according to the invention is described more in detail in the following referring to the enclosed drawing, where FIG. 1 shows a bottle hamper according to the invention from the side and partly as a section, FIG. 2 shows a vertical section of the bottle hamper along the line II—II in FIG. 1, FIG. 3 shows the bottle hamper from above, and FIG. 4 shows the bottle hamper in perspective, on a smaller scale.

The bottle hamper according to the invention preferably manufactured of plastic is formed by a frame 1, which on all sides has openings 2, 3, 4 and 5. Of these openings the bottle removal opening 2 on one long side of the hamper is the biggest. Its lower border is undulated the interspace between the wave crests corresponding to the bottle diameter. The hamper has a bottom 6 made of crosswise placed laths of plastic on which a framework 7 separating the lower parts of the bottles from each other is placed. This framework consists of longitudinal partitions 8, i.e. partitions parallel with the plane of the removal opening 2 and of to these partitions and thus also to the plane of the removal opening perpendicular partitions 9. The longitudinal partitions 8 have the same undulated form as the lower border of the removal opening and the upper edge of these partitions are also located at the same level as the bottom border of the removal opening. The smallest height of the partitions 8 corresponds to about 15% of the height of the bottles.

The construction of the crosswise placed partitions 9 can be seen especially in FIG. 2. In the lower part of the partitions lightening deep dents 10 are made above which there is a continuous part extending along the whole length of the partition. To the upper edge of this continuous element vertical upwards extending tongues 11 are attached and located on the symmetrical plane of each department, i.e. midway on the longitudinal partitions 8.

To both the vertical edges of the tongues 11 in the embodiment shown on the drawing a supporting device 12 is secured which, seen from above, is substantially V-shaped the junction of the arms being attached to the vertical edge of the tongue 11. As a consequence to the location of the supporting devices their arms extend into the compartments situated on different sides of the crosswise placed partitions 9, in which compartments they support the bottles in the direction of the partitions 9. In FIG. 3 is shown the position of one bottle 13 in its department supported by the supporting devices. The distance of the upper edge of the supporting devices 12 to the bottom of the hamper corresponds to about 45% of the height of the bottles. The arms of the supporting devices are of such an inflexible material that they do not straighten and press against each other when influenced by the pressure force caused by the bottles.

In order to support the bottles placed at the gable wall also from the side of the gable wall, therein are formed curved recesses 14 at each compartment.

When using a bottle hamper according to the invention it is filled at the brewery with bottles 13, of which there are 12 in the bottle hamper according to the drawing. When transporting the hampers from the brewery to the shops e.g. by truck, the load may sway so that the bottles try to get out through the removal opening. Because, in such a case, all the bottles incline in the direction of the removal opening simultaneuosly, the supporting devices are simultaneously subjected to contrary forces trying to displace them into the adjacent compartment. Because these forces are substantially of the same strength, it results in the supporting devices staying in their places and thus preventing the bottles from getting out through the removal opening. As already mentioned, the arms of the supporting devices do not bend so much that the bottles can get past them. As a consequence to the above, the bottles stay in the bottle hamper during transport despite the swaying of the load.

When the bottle hamper is in the shop, one bottle at a time can be removed from it through the removal opening 2 by grasping the bottle neck with a hand, by inclining the bottle forwards and by drawing the bottle through the removal opening out from the hamper. When the bottle presses against the supporting devices 12 located in its path, the tongues 11 attached to these supporting devices rotate somewhat around their vertical central axis, whereby the supporting devices located before the bottle move in the direction of the adjacent compartments and the supporting devices located behind the bottles and attached to the same tongue move closer to each other. The bottles are placed in their compartments so loosely that the supporting devices located before the bottle can move partly into the area of the adjacent compartments even if there are bottles in these compartments. When drawing bottles past the supporting devices, the arms of the supporting devices closest to the bottle bend somewhat so that they approach the plane of the tongues. This bending and the turning of the tongues enable together the removal of the bottles from the compartments.

All elements of the above-described bottle hamper are in one piece, so that after the casting there is no need to provide the hamper with separate movable elements.

The supporting devices 12 can within the scope of the invention be secured to the crosswise places partitions 9 in other ways than as described above. So the partitions can be, along their whole length, the height of the upper edge of the tongues 11, whereby protruding supporting devices are secured face to face to the side surfaces of the partitions. The partitions are in this case either wholly or around the protrusions so flexible that the supporting devices located before the bottle can move away from each other when a bottle is removed from its compartment.

The supporting devices can also have the shape of an equal-sided triangle, whereby the point can be attached to the vertical edge of the tongue. In this case, the supporting device itself is not at all elastic, but the removing of a bottle from its compartment is wholly dependent on the displacement of the supporting device.

Even if the invention is explained in connection with a bottle hamper, the solution according to the invention can be used also generally in transport boxes in which cylindrical objects are transported. The hamper can, if desired, be formed so that also opening 4 is made into a removal opening.

What we claim is:

1. A bottle hamper comprising a frame defining a plurality of sides, at least one side having an opening of a size sufficient for removal of a bottle therethrough;

a bottom;

a framework on said bottom below said opening to define compartments for a plurality of bottles within said frame to separate the bottles from each other, said framework having a plurality of parallel partitions perpendicular to said one side;

a plurality of vertical tongues extending upwardly frm each said partition; and a plurality of V-shaped supporting devices, each said device being flexibly secured to one vertical edge of a respective tongue and projecting into each of two adjacent compartments to retain a bottle in each adjacent compartment wherein each supporting device defines a pair of inflexible arms, each arm projecting horizontally into an adjacent compartment and extending horizontally towards said opening in said one side.

2. A bottle hamper as set forth in claim 1 wherein each supporting device has the shape of an equal-sided triangle with a point thereof attached to a respective vertical edge of a respective tongue.

3. A bottle hamper as set forth in claim 1 wherein said framework has a plurality of partitions perpendicular to and lower than said parallel partitions.

* * * * *